US007415978B2

(12) United States Patent
Mach

(10) Patent No.: US 7,415,978 B2
(45) Date of Patent: Aug. 26, 2008

(54) ASSEMBLY AND A METHOD FOR CUTTING OR FORMING AN OBJECT

(76) Inventor: William Mach, 33016 Oakleigh, Lenox Township, MI (US) 48048

( * ) Notice: Subject to any disclaimer, the term of this patent is extended or adjusted under 35 U.S.C. 154(b) by 0 days.

(21) Appl. No.: 10/961,318

(22) Filed: Oct. 4, 2004

(65) Prior Publication Data

US 2006/0076002 A1 Apr. 13, 2006

(51) Int. Cl.
*B28D 1/18* (2006.01)

(52) U.S. Cl. ..... 125/3; 125/11.01; 451/56

(58) Field of Classification Search ..... 125/3, 125/11.01, 11.03, 5, 11.04, 11.21; 451/37, 451/56, 72, 43, 229, 444
See application file for complete search history.

(56) References Cited

U.S. PATENT DOCUMENTS 4,760,668 A * 8/1988 Schlaefli ..... 451/56
4,924,842 A * 5/1990 Rao et al. ..... 125/11.01
4,984,390 A * 1/1991 Kobayashi ..... 451/443
5,538,460 A * 7/1996 Onodera ..... 451/72
5,551,908 A * 9/1996 Harada ..... 451/72
6,116,989 A * 9/2000 Balastik ..... 451/72
6,273,795 B1 * 8/2001 Hatamoto et al. ..... 451/56
6,361,412 B1 * 3/2002 Kaiser ..... 451/56

* cited by examiner

*Primary Examiner*—Jacob K Ackun, Jr.
(74) *Attorney, Agent, or Firm*—Law Offices of John Chupa & Associates, P.C.

(57) ABSTRACT

A method and an apparatus 10 for cutting an object 64, such as a grinding wheel. Particularly, the object 64 is placed in a horizontal manner and concomitantly rotated with the cutter 14 during the entire cutting operation. The rotation occurs are a relatively high speed and such concomitant rotation and such horizontal placement allows the cutting to occur in a desired manner.

3 Claims, 3 Drawing Sheets

ASSEMBLY AND A METHOD FOR CUTTING OR FORMING AN OBJECT

FIELD OF THE INVENTION

The present invention generally relates to an assembly and a method for cutting or forming an object and more particularly, to a method and an assembly for cutting and/or otherwise "working" and/or forming at least one surface of a grinding wheel or another object.

BACKGROUND OF THE INVENTION

An object, such as a grinding wheel, frequently must be cut or "worked/reworked" or "formed" in order to allow the object to achieve a desired working surface finish. By way of example and without limitation, a grinding wheel requires a new working surface finish after some period of usage due to the associated usage wear. This new working surface is typically achieved by selectively cutting or otherwise abrasively engaging the working surface in order to create a relatively smooth finish. It should thus be understood that the terms "working", "reworking", "cutting", and "forming" in this Application, all describe the process of creating a desired and relatively smooth working surface on a working surface of a wheel, or other object, by cutting and/or abrasively engaging the working surface.

While current techniques and strategies do provide the desired working surface on the targeted object, they suffer from some drawbacks. By way of example and without limitation, these techniques and strategies do not consistently provide desired surface tolerances, undesirably and structurally degrade the object and, in many situations, even cause structural damage to the targeted object, and require a relatively long period of time to perform. Such "uneven" tolerances will cause the object to perform poorly and such structural degradation may cause the object to be "valueless", thereby further increasing the cost of the overall process.

There is therefore a need and it is one non-limiting object of the invention to provide a method and an apparatus to overcome some or all of these previously delineated drawbacks and to, by way of example and without limitation, provide a method and an apparatus to selectively work, re-work, and/or cut and/or form an object, such as a grinding wheel, which overcomes some or all of the previously delineated drawbacks of prior techniques and strategies.

SUMMARY OF THE INVENTION

It is a first non-limiting object of the present invention to provide a method and an apparatus for working, forming, re-working, and/or cutting an object, such as a grinding wheel, in a manner which overcomes some or all of the previously delineated drawbacks of prior strategies and techniques.

It is a second non-limiting object of the present invention to provide a method and an apparatus for cutting a grinding wheel in a manner which allows desired surface tolerances to be achieved in a consistent, and desirable manner.

It is a third non-limiting object of the present invention to provide a method and an apparatus for cutting a grinding wheel in a manner which reduces the likelihood of undesired structural degradation while concomitantly producing a grinding wheel having a desired surface finish.

It is a fourth non-limiting object of the present invention to provide a method and, an apparatus for cutting a grinding wheel in a highly cost effective and efficient manner while concomitantly producing a grinding wheel having a desired-surface finish and reducing the likelihood of undesired structural degradation to the grinding wheel.

According to a first non-limiting aspect of the present invention a grinding wheel assembly for selectively cutting a grinding wheel is provided. Particularly, the grinding wheel assembly comprises a selectively rotatable cutter; a selectively rotatable grinding wheel support assembly; and a controller assembly which is communicatively and controllably coupled to the cutter and to the grinding wheel and which is effective to cause the cutter to selectively cut the grinding wheel only when the cutter and the grinding wheel are simultaneously and selectively rotated.

According to a second non-limiting aspect of the present invention, a grinding wheel assembly which is selectively adapted to allow a grinding wheel to be cut is provided. Particularly, the grinding wheel assembly comprises a support portion which allows a grinding wheel to be supported in a plane which is substantially parallel to the horizon; a cutter assembly which is wholly and operatively deployed in a plane which is perpendicular to the horizon; and a controller assembly which is operatively coupled to the support portion and which allows the cutter to cut the grinding wheel only when the grinding wheel is supported in the plane which is substantially parallel to the horizon and only when the cutter is deployed in said plane which is perpendicular to the horizon.

According to a third non-limiting aspect of the present invention, a grinding wheel assembly is provided. Particularly, the grinding wheel assembly includes a grinding wheel which is supported upon a floor and which is wholly contained within a plane which is parallel to the floor; a cutter which has a longitudinal axis of symmetry which is perpendicular to the plane which includes the grinding wheel; and a controller assembly which is operatively coupled to the grinding wheel and to the cutter and which selectively and independently rotates the cutter and the grinding wheel, effective to have the cutter selectively cut the grinding wheel.

According to a fourth non-limiting aspect of the present invention, an assembly is provided and includes a first and a second blank wheel, wherein each of the first and the second blanks are to be cut in a respective and certain manner which is defined by respective cutting information; a support table which is wholly and operatively contained in a plane which is substantially parallel to the horizon; a selectively rotatable cutter, wherein the cutter is also selectively and axially movable along the length of the support table and wherein the cutter has a longitudinal axis of symmetry which is substantially perpendicular to the plane which wholly contains the blanks; and a controller assembly which contains the respective cutting information for each of the blanks and which sequentially moves the cutter along the support table and selectively rotates the cutter according to the respective cutting information, thereby causing the cutter to sequentially cut each of the wheel blanks in a manner which is defined by the cutting information which is respectively and uniquely associated with each of the wheel blanks.

According to a fifth non-limiting aspect of the present invention, a method for cutting a wheel is provided and includes the steps of positioning the wheel substantially parallel to the horizon; providing a selectively rotatable cutter; and using the selectively rotatable cutter to cut the wheel only when the wheel is in the position which is substantially parallel to the horizon.

These and other features, aspects, and advantages of the present invention will become apparent from a consideration of the following detailed description of the preferred embodiment of the invention, including the subjoined claims, and by reference to the following drawings.

DETAILED DESCRIPTION OF THE PREFERRED EMBODIMENT OF THE INVENTION

Figure 1:
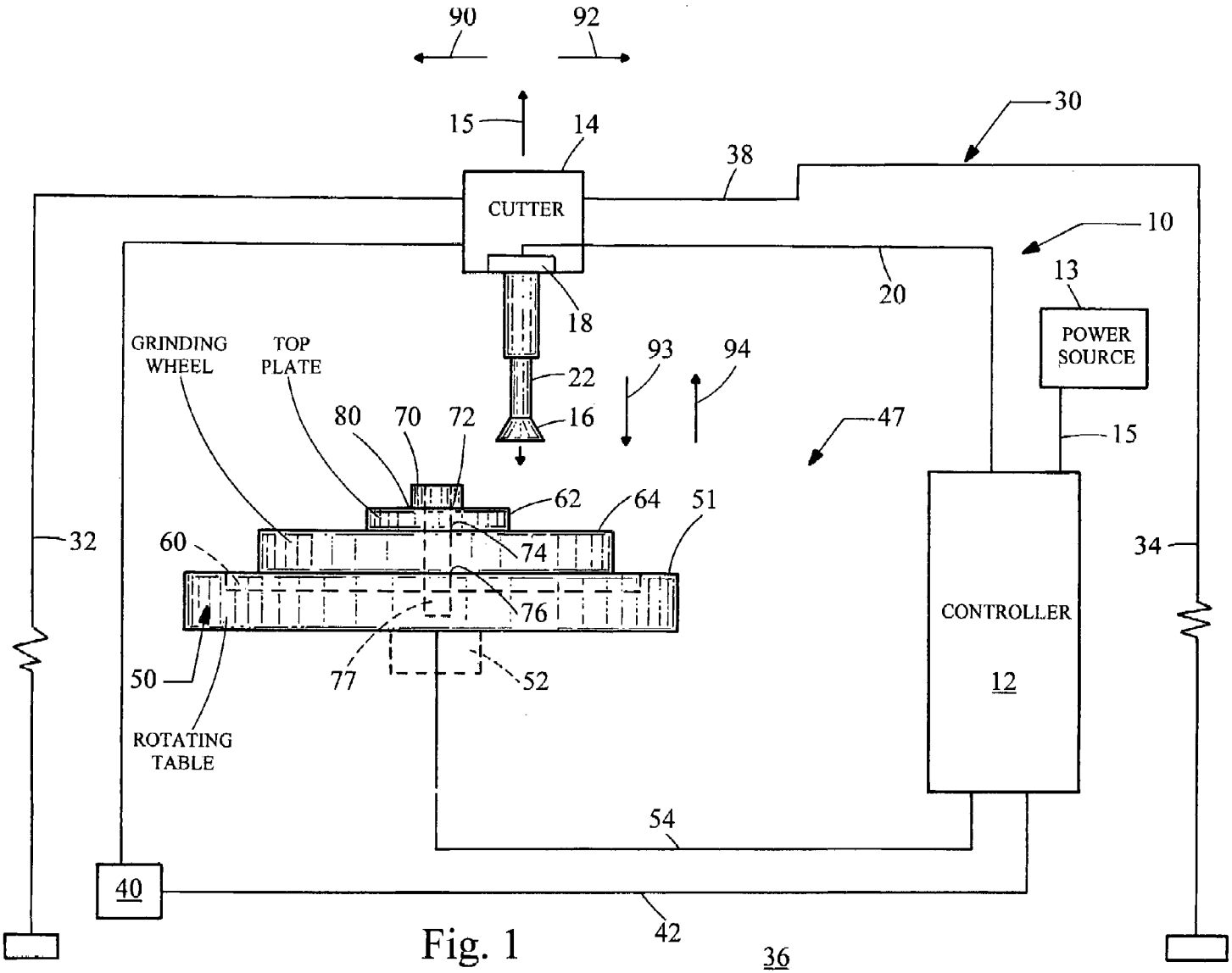
FIG. 1 is a block diagram of the assembly which is made in accordance with the teachings of the preferred embodiment of the invention.
Figure 2:
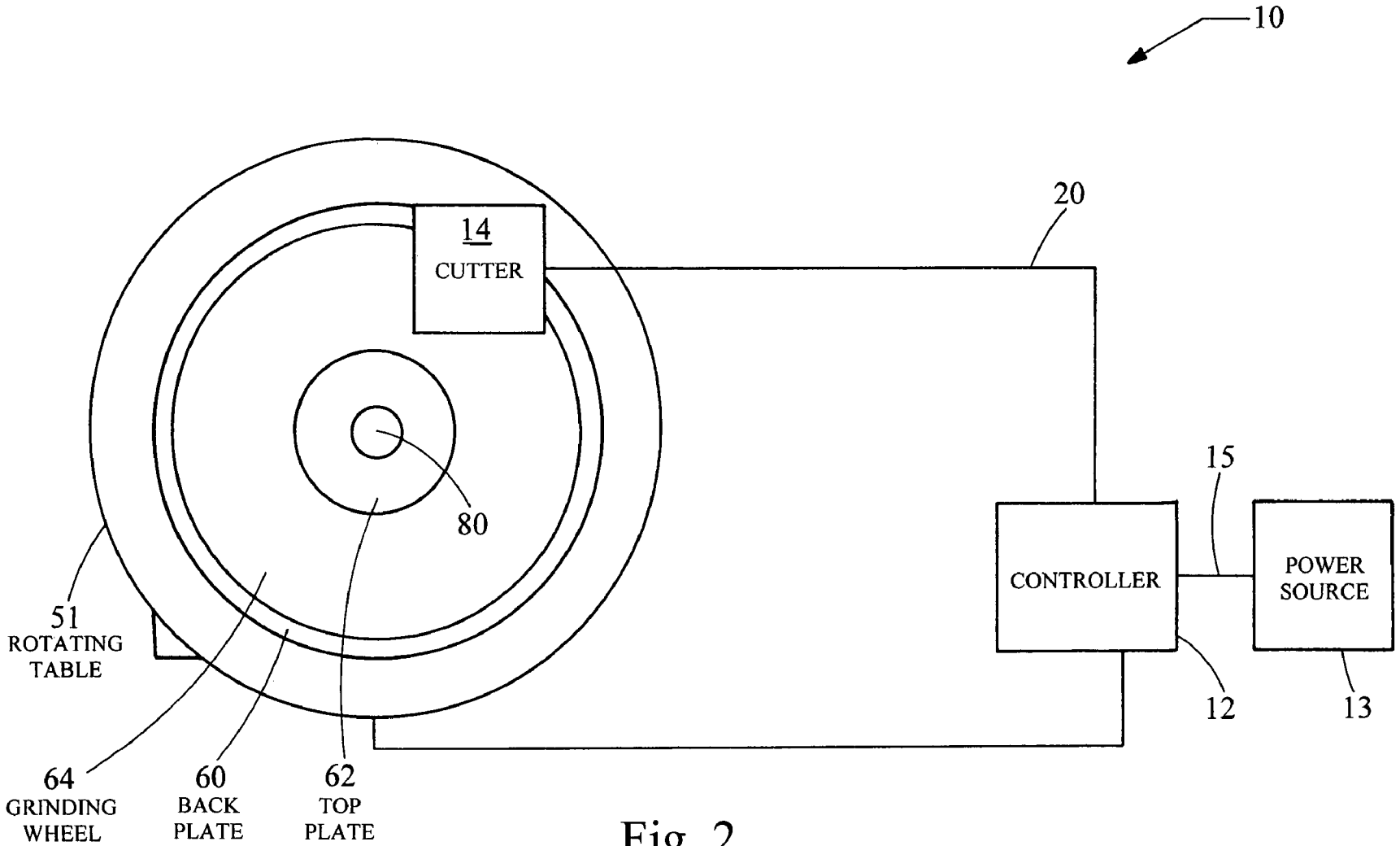
FIG. 2 is a top partial view of the assembly which is shown in FIG. 1.

Referring now to FIGS. 1 and 2, there is shown an assembly 10 which is made in accordance with the teachings of the preferred embodiment of the invention.

Particularly, the assembly 10 includes a controller 12 which is operable under stored program control and which may, in one non-limiting embodiment, comprise a commercially available and selectively programmable computer, such as a Vaio® type computer which is produced by the Sony® corporation and which includes a Pentium® IV processor. Other types of commercially available and selectively programmable computers may be utilized for controller 12. The controller 12 is physically and communicatively coupled to a source of electrical power 13 by the use of bus 15.

Further, the assembly 10 includes a cutter assembly 14 including, in the most preferred embodiment of the invention, a selectively removable and selectively rotatable diamond cutting tip portion 16. Further, the cutter assembly 14 includes a motor portion 18 which is physically and communicatively coupled to the controller 12 by the use of bus 20 and which further includes a selectively rotatable output shaft portion 22 which is removably and physically coupled to the selectively rotatable diamond cutting tip portion 16. As is further shown, the assembly 10 includes an overhead track assembly 30 having at least a pair of substantially similar leg portions 32, 34 which fixedly reside upon a floor or support surface 36. The portion 30 further includes an overhead track 38 which is deployed above the support surface 36 and which is supportably coupled to the at least two legs 32, 34 and which further movably receives the cutter 14. As shown, the overall track 38 spans across the distance or space residing between the top portions of the legs 32, 34 (i.e., those respective portions of legs 32, 34 most removed from floor 36).

The portion 30 further includes a motor assembly 40 which is physically and communicatively coupled to the controller 12 by the use of bus 42 and which is further physically coupled to the cutter 14, effective to move the cutter 14 along the track 38. In one non-limiting embodiment, the motor assembly 40 includes a motor and a movable chain (not shown) which is movably coupled to the track 38 and which supportably moves along the track 38 in response to movement of the motor (not shown). It should be realized that nothing in this description is meant to limit the inventions to the use of the overhead track portion 30 which has been generally described above, but that substantially any overhead track configuration which allows the cutter 14 to be selectively and movably deployed above the floor or support surface 36 may be employed as part of the assembly 10. Further, it should be appreciated that the surface of floor or support portion 36 is generally parallel to the horizon and that, in this embodiment of the invention, the cutter 14 includes a longitudinal axis of symmetry 15 which is generally perpendicular to the floor or support surface 36.

As is further shown in FIGS. 1 and 2, the assembly 10 includes a selectively rotatable support assembly 50 having a support table 51 which is physically coupled to a rotating actuator assembly 52 and the rotating actuator assembly 52 is physically and communicatively coupled to the controller 12 by the use of bus 54. Further, the assembly 10 includes a back plate member 60 which is selectively and removably fixed to the rotating table 51 and a top plate 62.

Particularly, in one non-limiting embodiment of the invention, the object to be cut, worked, reworked, or formed (e.g., a grinding wheel) 64 is selectively and removably fixed or "sandwiched" between the top plate 62 and the bottom plate 60 by the use of a bolt 70 which is adapted to be selectively inserted through aligned apertures 72, 74, 76 which are respectively created in top plate 62, object 64, and bottom plate 60. The bolt 70 is made to reside within the support table 51 as a blind aperture 77 is formed in the support table 51. In one non-limiting embodiment, the blind aperture 77 has complementary threads to the threads included within bolt 70, thereby allowing the bolt 70 to be threadably received into the blind aperture 77. Further, as shown, a nut 80 may be selectively and removably and threadably placed upon the bolt 70 to secure this "sandwich" configuration. Further, in the most preferred configuration, the radius of the top plate 62 is substantially smaller than the radius of the object 64 and the radius of the object 64 is substantially smaller than the radius of the back-plate 60. It should be appreciated that assembly which allows a table to selectively rotate.

After the object 64 is selectively and securely fastened or fixed between the top plate 62 and the bottom plate 60, in the manner shown in FIGS. 1 and 2, the controller 12 sources electrical power from the electrical power source, 13 to the motor 18, by the use of busses 15 and 20, thereby allowing the diamond tip cutting portion 16 to selectively rotate. The controller 12 may also source electrical power from the electrical power source 13 to the motor assembly 40, effective to allow the motor assembly 40 to move the cutter 14 in a desired position over the object 64 along the overhead track 38 and in directions defined by arrows 90, 92. In a non-limiting embodiment of the invention, the motor assembly 18 may also be adapted to move the diamond tip cutter portion 16 in directions defined by arrows 93, 94 in response to commands received from the controller 12 along bus 20. That is, the rotor of the motor assembly 18 may selectively and axially move along the longitudinal axis of symmetry 15. Further, the controller 12 may selectively source electrical power from the power source 13 to the actuator assembly 51, by the use of busses 15 and 54, thereby allowing the table 51 and the supporting object 64 to selectively rotate.

In the foregoing manner, it should be appreciated that the controller 12 may selectively cause the cutting portion 16 to be positioned in a desired spatial relationship with respect to the object 64 (e.g., having the cutting tip portion 16 frictionally and cuttingly engage the object 64). It should be further appreciated that in the foregoing manner, the cutting may only occur while the cutting tip portion 16 and the object 64, which is to be cut, worked, formed and/or re-worked, are both rotating and while the object 64 is maintained in a position which is substantially parallel to the floor or support portion 36 and substantially parallel to the horizon.

In one non-limiting embodiment of the invention, the object 64 is selectively rotated at a speed which is at least about 190 to about 200 revolutions per minute and the cutting tip portion 16 is selectively rotated at a speed which is at least about 7000 to about 7500 revolutions per minute during the entire cutting and/or working operation or cycle. Other speeds may be utilized in other non-limiting embodiments.

It has been found that the foregoing horizontal placement of the object 64 during the entire cutting operation or cycle allows such foregoing high speeds to be achieved while allowing desired surface and other tolerances to be realized on a consistent basis since such horizontal cutting substantially reduces the surface vibration traditionally occurring on the "worked" or cut surface of the object 64. Such high cutting or working or reworking speeds also allow the use of a diamond cutting tip portion 64 for a relatively long period of time without wear or failure, thereby further improving the overall achievable tolerance. Moreover, the concomitant rotation of the object 64 and the cutter portion 16 further reduces working surface vibration and allows the overall cutting process to be achieved very efficiently and very quickly.

It should be realized that the foregoing process is not limited to any type of particular object, such as a grinding wheel. Rather, the object 64 is representative of any type of object, including "blanks" or not fully formed or previously used objects and that all of the foregoing bus communication may be done in a wireless manner. Further, it should be appreciated that the cutter 14 may be moved, in alternate embodiments of the invention, to substantially any spatial position with respect to the horizontally disposed object 64 and that in another alternate embodiment only the cutting tip portion 16 or only the object 64 rotates.

Figure 3:
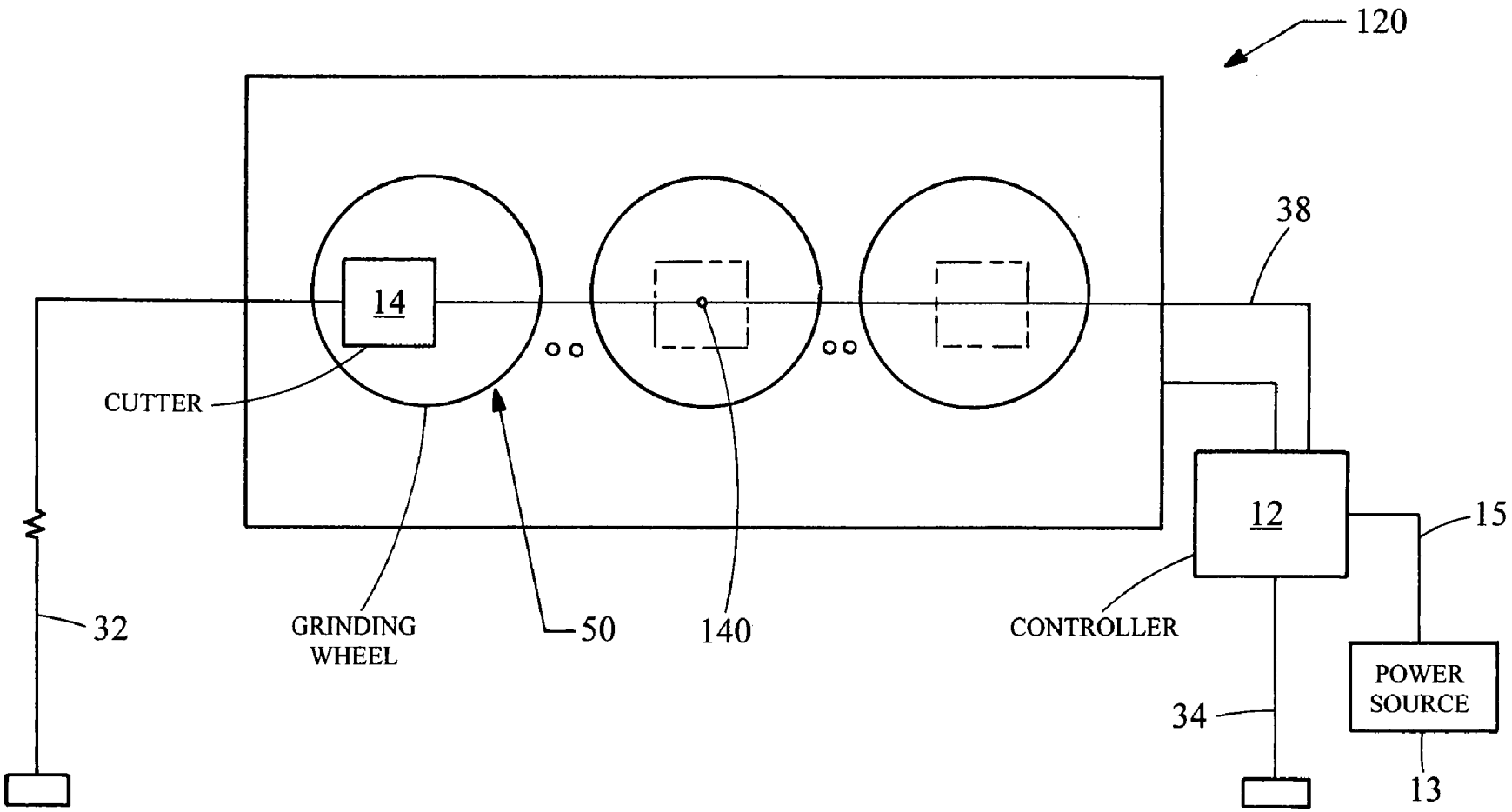
FIG. 3 is a partial top view of an assembly which is made in accordance with the teachings of an alternate embodiment of the invention.

Referring now to FIG. 3, there is shown an assembly 120 which is made in a second embodiment of the invention. Particularly, the assembly 120 is substantially identical to the assembly 10 (e.g., portions which like reference numerals are the same and many portions are not shown), except that multiple support assemblies, substantially similar to selectively rotatable support assembly 51 are axially deployed along the floor 36 and substantially parallel to the horizon. Each of these support assemblies 51 has a unique object, such as object 64, to be cut, formed, worked, or reworked. In this embodiment, each such object is substantially similar.

In operation, the controller 12 includes the cutting information associated with each such object (e.g., each object is to be cut in a substantially similar manner) and the objects to be so cut are "lined up" in the manner shown. The controller 12 then sequentially moves the cutter 14 to sequentially cut each object and such movement is made, along the track 38, by the use of the center points 140 of each such object. This sequential and axial cutting allows many objects to be cut or configured in a highly efficient manner (e.g., they are formed in the order that they are "lined up"). It should be further understood that the object 64 may be selectively engaged by the cutter 14 while the object 64 substantially resides in a plane which is perpendicular to the floor 36. In other non-limiting embodiments, the cutter 14 (i.e., the tip 66) may rotate while the object 64 remains stationary.

It is to be understood that the inventions are not limited to the exact construction and embodiment which has been described above, but that various changes and modifications may be made without departing from the spirit and the scope of the inventions as they are delineated in the following claims. It should be further understood that the foregoing inventions may be used with any new and/or used objects, such as grinding wheels.

What is claimed is:

1. A method for forming a grinding wheel comprising the steps of first, obtaining a blank wheel having an edge and a body portion wherein said body portion has a certain radius; providing a bottom plate having a radius which is smaller than said certain radius; providing a top plate having a radius which his smaller than said certain radius; fixedly positioning the blank wheel to said bottom plate; fixedly positioning the blank wheel to said top plate, effective to cause said blank wheel to be securely fastened and fixed between said top and bottom plates; causing said blank wheel which is fixed positioned between said top and bottom plates to be horizontally positioned; providing a selectively rotatable cutter having a longitudinal axis of symmetry; providing a track; positioning said track over said top plate, bottom plate, and over said blank wheel which is fixedly positioned between said top and bottom plates; movably attaching said cutter to said track such that said longitudinal axis of symmetry of said cutter is always perpendicular to said blank wheel; rotating said blank wheel while constraining said cutter to rotate and only to selectively move in two opposed and opposite first and second directions which are both parallel to said blank wheel and only in two opposed and opposite third and fourth directions which are both perpendicular to said blank wheel, wherein said third direction is toward said blank wheel and said fourth direction is away from said blank wheel and when said cutter is operational, said cutter is only to rotate and move in said first, second, third, and fourth directions; moving said cutter to a first location at said edge of said blank wheel; selectively cutting said blank wheel at said first location only when said cutter and said blank wheel are each concurrently being rotated and only when said blank wheel is in said horizontal position; moving said cutter to a second location upon said body of said blank wheel; cutting said second location of said body of said blank wheel only when said cutter and said blank wheel are each concurrently being rotated and only when said blank wheel is in a horizontal position; and cutting other desired positions of said blank wheel, wherein such cutting only occurs only when said cutter and said blank wheel are each concurrently being rotated and only when said blank wheel is in a horizontal position and only when said blank wheel is fixedly positioned between said top and said bottom plates.

2. The method of claim 1 further comprising the step of placing a diamond tip upon said cutter.

3. The method of claim 2 further comprising the step of placing a bolt through said top plate, said bottom plate, and said blank wheel, thereby fixedly positioning said blank wheel between said top and bottom plate.

* * * * *